United States Patent [19]

Studer et al.

[11] 4,321,572

[45] Mar. 23, 1982

[54] NON-CONTACTING POWER TRANSFER DEVICE

[75] Inventors: Philip A. Studer, Silver Spring; John Paulkovich, Lanham, both of Md.

[73] Assignee: The United States of America as represented by the Administrator of the National Aeronautics and Space Administration, Washington, D.C.

[21] Appl. No.: 206,506

[22] Filed: Nov. 13, 1980

[51] Int. Cl.[3] ..... H01F 15/02

[52] U.S. Cl. ..... 336/83; 336/120

[58] Field of Search ..... 336/120, 83, 119, 118, 336/117, 115, 130, 121

[56] References Cited

U.S. PATENT DOCUMENTS

| | | | |
|---|---|---|---|
| Re. 27,195 | 10/1971 | Klug | 336/130 |
| 2,588,406 | 3/1952 | Munson | 336/121 |
| 2,703,392 | 3/1955 | Rex | 336/130 |
| 3,019,403 | 1/1962 | Kamm | 336/120 |
| 3,491,321 | 1/1970 | Chass | 336/130 |
| 3,531,748 | 9/1970 | Tueter et al. | 336/120 |
| 3,609,615 | 9/1971 | Parker et al. | 336/83 X |
| 3,611,230 | 10/1971 | Maake | 336/120 |
| 3,790,811 | 2/1974 | Cooper et al. | 336/120 X |
| 3,818,401 | 6/1974 | Mouri et al. | 336/119 |
| 3,924,174 | 12/1975 | Fahrner | 336/120 X |
| 4,117,436 | 9/1978 | MacLennan | 336/120 |

FOREIGN PATENT DOCUMENTS

| | | | |
|---|---|---|---|
| 511637 | 9/1976 | U.S.S.R. | 336/120 |

*Primary Examiner*—Thomas J. Kozma

*Attorney, Agent, or Firm*—John O. Tresansky; John R. Manning; Ronald F. Sandler

[57] ABSTRACT

A transformer (20) for coupling AC electrical energy from a stationary element (22) to a rotating element (24) without the use of sliding contacts. The transformer (20) is of the rotary type and includes a ferrite core (39) and two primary windings (70 and 72) which are stationary with respect to a secondary winding (88) which rotates within an annular cavity (48) adjacent an axial bore (58) in the core. The core (39) is comprised of two cup type core halves (40 and 42). Electrical connection to the secondary winding (88) is made through a split bobbin assembly (89) which couples to a coaxial shaft assembly (59) located in the axial bore (58). The electrical coupling to the coaxial shaft assembly is made through a continuous transverse channel (68) connecting the axial bore (58) with the annular cavity (48). The transverse channel (68) forms a single air gap; however, it is not open directly to free space but is shielded by the magnetic permeable material of the core halves (40 and 42).

11 Claims, 6 Drawing Figures

NON-CONTACTING POWER TRANSFER DEVICE

ORIGIN OF THE INVENTION

The invention described herein was made by employees of the United States Government and may be manufactured and used by or for the Government for governmental purposes without the payment of any royalties thereon or therefor.

TECHNICAL FIELD

The invention relates generally to electrical transformers and more particularly to transformers where there is relative motion between the primary and secondary winding.

BACKGROUND ART

The invention described herein has particular utility in applications where electrical power is coupled from a stationary location to a moving location with a minimum of radio frequency and electromagnetic interference. Such an environment is encountered in spacecraft containing extremely sensitive electronic components which are being fed power from an on-board source via a transformer.

Known prior art apparatus for coupling electromagnetic energy across a moving boundary or interface consist of rotary transformers, close coupled antennas, and capacitive plates. The disadvantages of known prior art transformer apparatus include the presence of an external air gap separating the two moving elements from which electrical energy leaks or is radiated away. Additionally, rotary transformers are sensitive to translational and/or rotational motions and the lack of parallelism between opposing, although non-contacting, surfaces results in changes in the electromagnetic coupling between the elements. Capacitive devices are subject to changes in their operational medium such as humidity and have a tendency to arc. In addition, where mutual rotation between elements is required, sliding contacts are often used to couple energy from the moving member, particularly where a rotation of 360° is provided.

STATEMENT OF THE INVENTION

Accordingly, it is an object of the invention to provide non-contacting means for coupling electromagnetic energy across a moving interface.

It is another object of the invention to provide transformer means for coupling electromagnetic energy across a moving boundary without the use of sliding contacts.

Another object of the invention is to provide a transformer having one winding which is adapted to rotate 360° with respect to the other winding.

Still another object of the invention is to provide a transformer having a relative rotation between windings while substantially minimizing electromagnetic flux leakage therefrom.

Yet another object of the invention is to provide a rotary transformer wherein the flux coupling is substantially constant regardless of angular position or velocity of the moving winding.

These and other objects are achieved by means of a transformer for coupling alternating electrical energy between a stationary winding and a moving winding via a magnetic circuit element which has a core of magnetically permeable material which is also stationary relative to the moving winding. The magnetic circuit element comprises a toroidal core assembly having an interior annular cavity for enveloping fixed and movable annular winding assemblies. The movable winding assembly is freely rotatable within the cavity and couples to the outside via a coaxial shaft assembly located in an axial bore through the toroidal core. The rotatable winding is wound on a split bobbin assembly which connects to electrically insulated inner and outer conductors of the shaft assembly. While an air gap is provided, it is not open directly to free space, but is located within the core so that the core itself provides a magnetic shield to minimize flux leakage.

The foregoing as well as other objects, features and advantages of the present invention will become more apparent from the following detailed description taken in conjunction with the appended drawings.

DETAILED DESCRIPTION OF THE INVENTION

Figure 1:
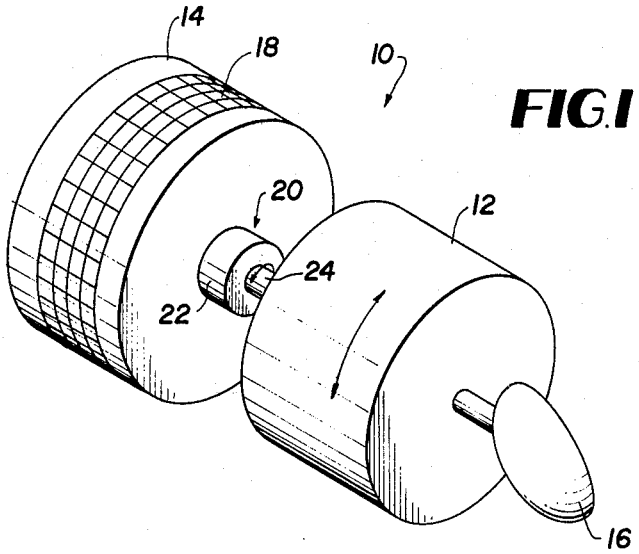
FIG. 1 is a perspective view of apparatus which is adapted to utilize the present invention.
Figure 5:
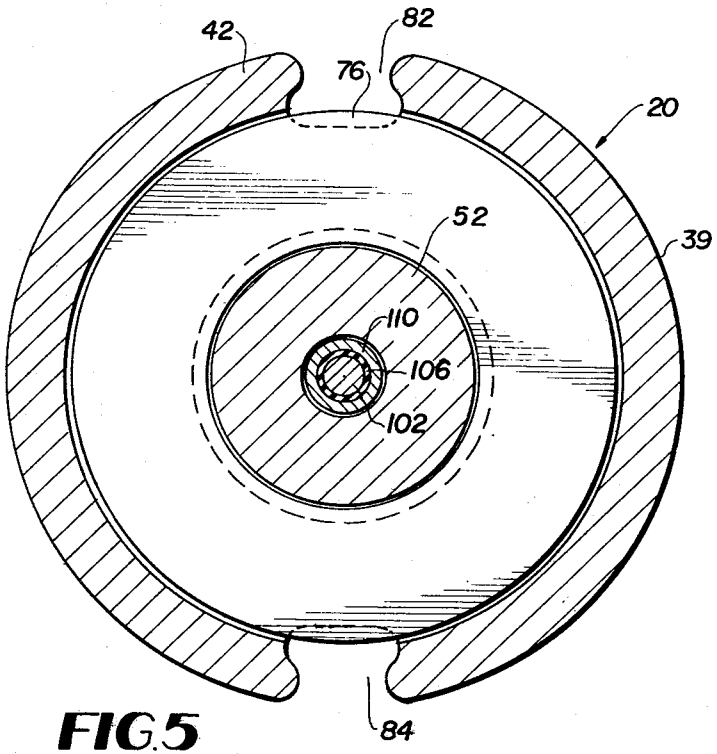
FIG. 5 is a sectional view of the embodiment shown in FIG. 4 taken along the lines 5—5 thereof.
Figure 4:
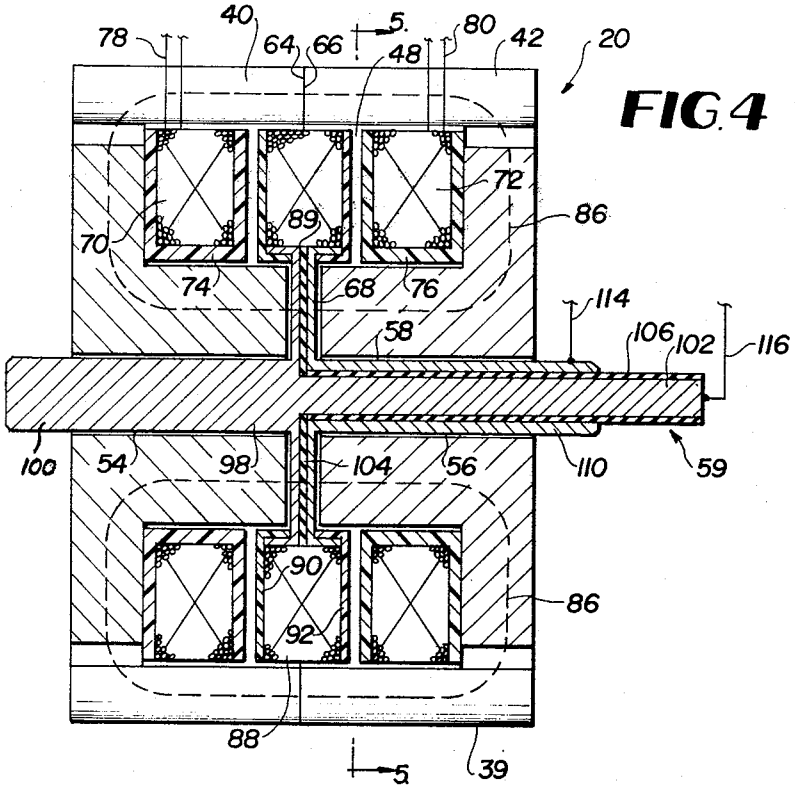
FIG. 4 is a cross sectional view of one embodiment of the subject invention.
Figure 6:
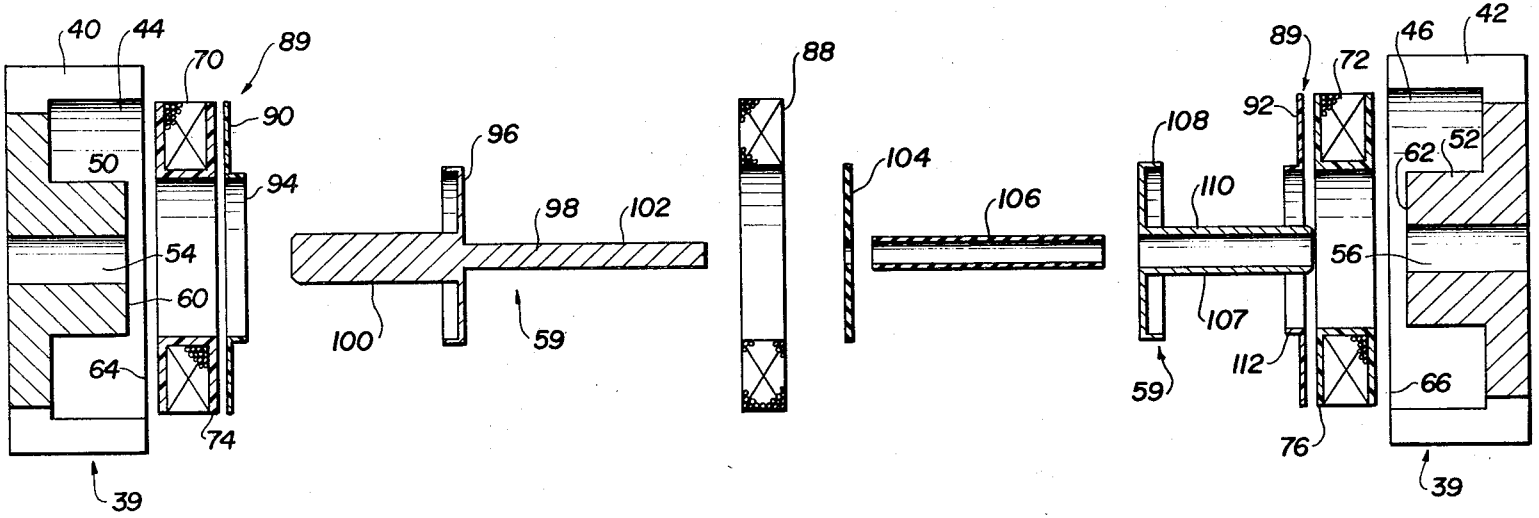
FIG. 6 is an exploded central cross sectional view illustrating the relative shape and position of the various elements of the embodiment shown in FIG. 4.

Referring now to the drawings and more particularly to FIG. 1, the apparatus disclosed therein is intended to illustrate a typical operational environment for the invention, the details of which are illustrated in FIGS. 4 through 6. Reference numeral 10 is intended to designate generally an orbital spacecraft, or the like, having one section 12 rotatable with respect to a second section 14 along a common central longitudinal axis. Section 12, for example, may house an electronics surveillance or communications system coupled to a directable antenna system 16 while being powered from a power supply contained in the section 14 having a solar powered array 18 peripherally located on its outer surface. To couple power from the section 14 to the section 12, some type of rotary transfer device is required. Accordingly, reference numeral 20 designates a rotary transformer in accordance with the subject invention having a stationary portion 22 and a rotatable portion 24 coupled between the sections 14 and 12, respectively.

Figure 2:
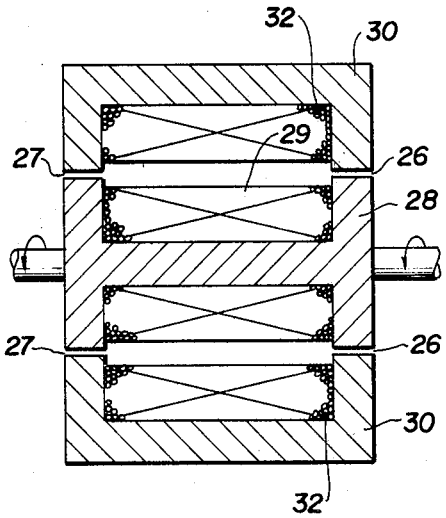
FIG. 2 PRIOR ART
FIG. 2 is a central cross sectional diagram illustrative of a typical prior art rotary transformer.

Due to the relative sophistication and complexity of current spacecraft systems, the presence of undesired RF and electromagnetic interference greatly affects the performance sensitivity of the circuitry proximate to the transformer device 20. In an effort to illustrate the manner in which the aforesaid undesirable interference is generated in a rotary transformer typically illustrative of the prior art, reference is now made to FIG. 2. What is significant about the device shown in FIG. 2 is the requirement for outside air gaps 26 and 27 between a rotatable core member 28 on which is wound a winding 29 and a stationary core member 30 on which is located a winding 32. The presence of the air gaps 26 and 27 provide flux leakage apertures of electromagnetic energy from the interior of the device to the outside, whereupon it can be radiated as a form of undesirable interference.

Figure 3:
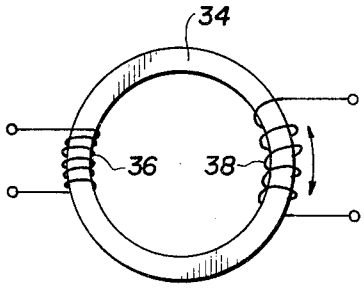
FIG. 3 is an electrical schematic diagram broadly illustrative of the present invention.

To eliminate the problem of the air gap flux leakage in a transformer where relative movement between windings is desired, reference is now made to FIG. 3 which discloses an embodiment of such a device wherein a continuous magnetic circuit in the form of a toroidal core 34 remains fixed with a primary winding 36 firmly wound thereon. The secondary winding 38, however, while being wound around the toroidal core, is adapted to move in a circular or arcuate path around the core until it comes into contact with the primary winding 36. In such a configuration, no air gap leakage occurs, but movement of the secondary winding 38 has limited translation and/or rotation around the core 34 of less than 360°.

Referring now to one embodiment of the invention, reference is made collectively to FIGS. 4, 5 and 6. Shown is a rotary transformer wherein both the magnetic circuit in the form of a magnetizable core and one winding remains fixed while the other winding is movable, i.e. rotatable, relative thereto and is capable of continuous 360° rotation. An air gap or discontinuity in the magnetic circuit does exist; however, it is not open directly to free space but is situated within the interior of the magnetic core which provides a self-shielding effect. Reference numeral 20 generally designates the rotary transformer structure shown in FIG. 1 including the fixed member 22 and a rotatable member 24. The transformer 20 comprises, in addition to a winding to be described, a generally cylindrical or toroidal core 39 of magnetically permeable material, e.g. ferrite, comprised of two contiguous cup type core half sections 40 and 42, the details of which are shown in FIG. 6. The core halves 40 and 42 respectively include annular slots 44 and 46 which, when the core halves are joined together in a face-to-face relationship, define an annular cavity 48 shown in FIG. 4. The inner hub portions 50 and 52 of the core halves 40 and 42, respectively, contain axial bores 54 and 56 which define a central axial bore 58 adapted to accommodate a coaxial shaft assembly 59. The respective inner surfaces 60 and 62 of the hub portions 50 and 52 are recessed with respect to the respective outer ring surfaces 64 and 66 of the core halves to provide an interior continuous transverse channel 68 which forms a single internal air gap 68. No external air gap exists because the outer surfaces 64 and 66 are in contact with one another.

Within the annular cavity 48 formed by the annular cores 40 and 42 there is located a pair of fixed toroidal windings 70 and 72 respectively wound on a pair of insulated bobbins 74 and 76 which are secured to the respective core halves 40 and 42 as shown in FIG. 4. Pairs of electrical leads 78 and 80 for the windings 70 and 72, respectively, are adapted to be brought out through one of a pair of longitudinal slots 82 and 84, shown in FIG. 5, which are formed in the rim portion of the core halves 40 and 42.

The windings 70 and 72 preferably act as a composite primary winding. As such the electrical lead pairs 78 and 80 are adapted to be connected together in parallel and upon coupling an electrical energizing potential to the windings 70 and 72, a magnetic flux will be generated which will travel in path 86 (FIG. 4) through the core assembly and across the air gap 68. Inasmuch as the longitudinal slots 82 and 84 are parallel to the flux direction, their presence is inconsequential to the behavior and operation of the transformer and can when desirable, be deleted.

A particularly significant feature about the preferred embodiment of the invention is the inclusion of a rotatable secondary winding assembly including a annular winding 88 wound on a split bobbin assembly 89 connected to a coaxial conductor type of shaft assembly 59 shown in FIG. 4. The winding 88 is located in the annular cavity 48 between the windings 70 and 72 and is connected to the coaxial shaft assembly 59 through the transverse air gap channel 68. As best shown in FIG. 6, the split bobbin 89 is comprised of two opposing like half sections 90 and 92 formed of non-conducting material such as plastic. The two bobbin half sections 90 and 92 correspond to the bobbins 74 and 76, but which have been separated in their mid-portions so that the bobbin half 90 comprises the left portion, while the bobbin half 92 comprises the right portion.

The plastic bobbin half 90 includes a circular hub 94 which is adapted to interfit with the circular radial flange 96 of a first flanged shaft member 98 whose enlarged diameter portion 100 is adapted to pass through the bore section 54 of the core half 40. The smaller diameter portion 102 extends inwardly to engage a circular insulator disk 104 and an elongated insulated sleeve 106 which passes through a second flanged shaft member 107. The second shaft member 107 includes a circular radial flange portion 108 and a protruding portion 110. The flange portion 108 is adapted to interfit with the circular hub portion 112 of the plastic bobbin half 92 while the protruding portion is adapted to pass through the bore section 56 of the core half 42. The inner and outer shaft portions 98 and 107 and their respective flange portions 96 and 108 are adapted to be electrically conductive. The opposite ends of the winding 88 are electrically connected thereto and accordingly electrical contact is made from the winding 88 to the coaxial inner shaft portion 102 and the outer shaft portion 110 as shown in FIG. 4.

Accordingly, with split bobbin 89 joined to shaft assembly 59, the winding 88 is adapted to rotate freely inside of the toroidal core 39 between the two fixed windings 70 and 72. Since the coaxial shaft portions 102 and 110 pass through the axial bore portion 56 of the core, electrical leads 114 and 116 can be connected thereto for coupling to apparatus, not shown. While the embodiment shown in FIG. 4 includes two stationary windings 70 and 72 which are adapted to operate as a common primary winding, they are included merely for purposes of symmetry. Accordingly, when desirable, a single stationary winding may be employed.

In operation, excitation of the windings 70 and 72 by AC currents applied to the leads 78 and 80 set up alternately reversing flux shown by the flux path 86 in the composite toroidal core consisting of the "cup core" members 40 and 42. Since the flux path completely surrounds the secondary winding 88, an induced voltage is provided in the winding 88 which is unaffected by its physical rotation provided by the shaft assembly 24. In contrast with the prior art apparatus which normally uses a pair of concentric magnetic elements, one carrying the primary coil and the other carrying the secondary coil, the subject invention eliminates magnetic force interaction between permeable ferrous surfaces because all of the ferrous material remains fixed. Thus what has been shown and described is an improvement in transformer apparatus which is adapted to transfer electrical power across a movable interface without the use of sliding contacts and in such a way that undesired electromagnetic emissions is substantially reduced by the single air gap 68 being inside the core 39.

Having thus shown and described what is at present considered to be the preferred embodiment of the subject invention, modifications, alterations and changes may be resorted to without departing from the spirit or scope of the invention as set forth in the appended claims.

We claim:

1. A rotary transformer (20), comprising:

a magnetic core (39) of magnetically permeable material, having a central axial bore (58), an annular cavity (48) adjacent said axial bore (58), and a continuous transverse channel (68) forming an air gap between said axial bore (58) and said annular cavity (48);

first electrical winding means (70, 72) wound about and in stationary contact with said magnetic core (39);

an electrical winding (88) located in said annular cavity (48), wound on a split bobbin about said magnetic core (39) and rotatable relative to said magnetic core (39) and said first winding means (70, 72) while maintaining a substantially constant flux coupling with said first winding means (70, 72) during energization of said first winding means (70, 72) independently of the positional relation between said rotatable winding and said magnetic core (39);

an electrically conductive coaxial shaft assembly (98 and 107) freely rotatable in said axial bore (58); and means (96 and 108) for coupling said coaxial shaft assembly (98 and 107) to opposite sides of said rotatable winding (88) through said split bobbin (89).

2. The transformer of claim 1 wherein said first electrical winding means comprises windings (70, 72) spaced apart on said core on opposite sides of said rotatable winding.

3. The transformer of claim 1 wherein said first electrical winding means comprises at least one winding (70) locating in said annular cavity (48) adjacent said rotatable winding (88).

4. The transformer of claim 1 wherein said first electrical winding means comprises a pair of windings (70 and 72) located on opposite ends of said rotatable winding (88).

5. The transformer of claim 1 wherein said first winding means comprises a pair of windings (70 and 72) wound in said annular cavity (48) and adapted to be connected in parallel to operate as a composite primary winding, and said rotatable electrical winding (88) is located intermediate of said pair of windings (70 and 72) and adapted to operate as a secondary winding.

6. The transformer of claim 1 wherein said coupling means includes a pair of outwardly extending flange members (96 and 108) insulated from one another for making electrical contact with opposite ends of said rotatable winding (88).

7. The transformer of claim 6 wherein said coaxial shaft assembly (98 and 107) includes a pair of shaft members (102 and 110) separated by a sleeve (106) of insulating material and wherein said outwardly extending flange members (96 and 108) are separated by a layer (104) of insulating material whereby electrical insulation exists between opposite ends of said rotatable winding (88) and said pair of shaft members (102 and 110).

8. The transformer of claim 1 wherein said first electrical circuit means comprises a pair of windings (70 and 72) wound on different bobbins (74 and 76) and located on opposite sides of said split bobbin assembly (89) in said annular cavity (48).

9. The transformer as defined by claim 1 wherein said core (39) is comprised of a body having a generally cylindrical cross section.

10. The transformer as defined by claim 1 wherein said core (39) is comprised of two core halves (40 and 42) generally cylindrical in shape and including inwardly projecting respective hub portions (50 and 52) having respective bores (54 and 56) which form said central axial bore (58) and wherein said core halves (40 and 42) are bonded together such that their respective hub portions face one another.

11. The transformer as defined by claim 10 wherein said two core halves (40 and 42) comprise a pair of ferrite cup core members.

* * * * *